US005211836A

United States Patent [19]

Forester

[11] Patent Number: 5,211,836

[45] Date of Patent: May 18, 1993

[54] REACTION PRODUCTS OF POLYALKENYL SUCCINIC ANHYDRIDES WITH AROMATIC SECONDARY AMINES AND AMINOALCOHOLS AS PROCESS ANTIFOULANTS

[75] Inventor: David R. Forester, Conroe, Tex.

[73] Assignee: Betz Laboratories, Inc., Trevose, Pa.

[21] Appl. No.: 849,926

[22] Filed: Mar. 12, 1992

[51] Int. Cl.[5] ..... C10G 9/16

[52] U.S. Cl. ..... 208/48 AA; 208/48 R; 585/950

[58] Field of Search ..... 208/48 AA, 48 R; 252/51.5 A

[56] References Cited

U.S. PATENT DOCUMENTS 3,235,484 2/1966 Colfer ..... 208/48
4,522,736 6/1985 Andress et al. ..... 252/51.5 A
4,578,178 3/1986 Forester ..... 208/48
4,883,886 11/1989 Huang ..... 549/255

*Primary Examiner*—Theodore Morris
*Assistant Examiner*—Walter D. Griffin
*Attorney, Agent, or Firm*—Alexander D. Ricci; Richard A. Paikoff

[57] ABSTRACT

Reaction products of polyalkenyl succinic anhydrides with aromatic secondary amines, then further reacted with aminoalcohols are used as effective antifoulants in liquid hydrocarbonaceous mediums, such as crude oils and gas oils, during processing of such liquids at elevated temperatures. The reaction products are formed via a two-step reaction in which a polyalkenylsuccinic anhydride precursor is reacted with an aromatic secondary amine to form polyalkenylsuccinamide intermediate which, in turn, is reacted with an aminoalcohol.

6 Claims, No Drawings

REACTION PRODUCTS OF POLYALKENYL SUCCINIC ANHYDRIDES WITH AROMATIC SECONDARY AMINES AND AMINOALCOHOLS AS PROCESS ANTIFOULANTS

FIELD OF THE INVENTION

The present invention pertains to the use of reaction products of polyalkenyl succinic anhydrides with aromatic secondary amines and aminoalcohols to inhibit fouling in liquid hydrocarbon mediums during the heat treatment processing of the medium, such as in refinery processes.

BACKGROUND OF THE INVENTION

In the processing of petroleum hydrocarbons and feed stocks, such as petroleum processing intermediates, and petrochemicals and petrochemicals intermediates, e.g., gas, oils and reformer stocks, chlorinated hydrocarbons and olefin plant fluids, such as deethanizer bottoms, the hydrocarbons are commonly heated to temperatures of 40° to 550° C., frequently from 200°–550° C. Similarly, such petroleum hydrocarbons are frequently employed as heating mediums on the "hot side" of heating and heating exchange systems. In both instances, the petroleum hydrocarbon liquids are subjected to elevated temperatures which produce a separate phase known as fouling deposits, within the petroleum hydrocarbon. In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shut-downs for cleaning. Moreover, these deposits reduce throughput, which of course results in a loss of capacity with a drastic effect in the yield of finished product. Accordingly, these deposits have caused considerable concern to the industry.

While the nature of the foregoing deposits defies precise analysis, they appear to contain either a combination of carbonaceous phases which are coke-like in nature, polymers or condensates formed from the petroleum hydrocarbons or impurities present therein and/or salt formations which are primarily composed of magnesium, calcium and sodium chloride salts. The catalysis of such condensates has been attributed to metal compounds such as copper or iron which are present as impurities. For example, such metals may accelerate the hydrocarbon oxidation rate by promoting degenerative chain branching, and the resultant free radicals may initiate oxidation and polymerization reactions which form gums and sediments. It further appears that the relatively inert carbonaceous deposits are entrained by the more adherent condensates or polymers to thereby contribute to the insulating or thermal opacifying effect.

Fouling deposits are equally encountered in the petrochemical field wherein the petrochemical is either being produced or purified. The deposits in this environment are primarily polymeric in nature and do drastically affect the economies of the petrochemical process. The petrochemical processes include processes ranging from those where ethylene or propylene, for example, are obtained to those wherein chlorinated hydrocarbons are purified.

Other somewhat related processes where antifoulants may be used to inhibit deposit formation are the manufacture of various types of steel or carbon black.

SUMMARY OF THE INVENTION

In accordance with the invention, reaction products of polyalkenyl succinic anhydrides with aminoalcohols and aromatic secondary amines are used to inhibit fouling of heated liquid hydrocarbon mediums. Typically, such antifoulant protection is provided during heat processing of the medium, such as in refinery, purification, or production processes.

The reaction products of polyalkenyl succinic anhydrides with aminoalcohols and aromatic secondary amines are formed via a two-step reaction. In the first step, a polyalkenyl succinic anhydride is reacted with an amine, preferably an aromatic secondary amine, in order to form a polyalkenylsuccinamide intermediate. The intermediate is then reacted with an aminoalcohol to form the desired reaction product.

PRIOR ART

U.S. Pat. No. 4,522,736 (Andress et al.) describes the reaction products of polyalkenyl succinic anhydrides with aromatic secondary amines (e.g., diphenylamine), then further reacted with aminoalcohols (e.g., triethanolamine). These products are claimed to function as dispersant additives when added to lubricating oils and tested in diesel engines. In contrast, the present invention calls for inhibition of fouling in liquid hydrocarbonaceous mediums during the high temperature processing of the medium. Studies have indicated that many compounds known to be useful as lubricating oil detergent dispersants do not adequately function as process antifoulants during heat treatment processing of the treated medium.

DETAILED DESCRIPTION OF THE INVENTION

I have found that the reaction products of polyalkenyl succinic anhydrides with aromatic secondary amines, then further reacted with aminoalcohols provide significant antifoulant efficacy in liquid hydrocarbonaceous mediums during the high temperature treatment of the medium.

It is to be understood that the phrase "liquid hydrocarbonaceous medium" as used herein signifies various and sundry petroleum hydrocarbon and petrochemicals. For instance, petroleum hydrocarbons such as petroleum hydrocarbon feedstocks including crude oils and fractions thereof such as naphtha, gasoline, kerosene, diesel, jet fuel, fuel oil, gas oil, vacuum residua, etc., are all included in the definition.

Similarly, petrochemicals such as olefinic or naphthenic process streams, aromatic hydrocarbons and their derivatives, ethylene dichloride, and ethylene glycol are all considered to be within the ambit of the phrase "liquid hydrocarbonaceous mediums".

The reaction products useful in the invention are generally prepared via a two-step reaction. In the first step, a polyalkenylsuccinic anhydride is reacted with an aromatic secondary amine, such as diphenylamine to form the desired succinamide. Then, the succinamide is reacted with an aminoalcohol (e g., triethanolamine) in an organic solvent medium to form the desired reaction product.

More specifically, the starting reactant, polyalkenylsuccinic anhydride may be purchased commercially or prepared. Presently, it is preferred to buy this from Texaco. One such commercially sold polyalkenylsuccinic anhydride is sold under the trademark TLA-627. It is a polyisobutenylsuccinic anhydride (PIBSA) having the structure

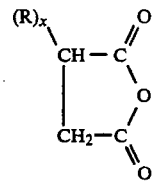

(I)

wherein, in this case, R is an isobutenyl repeat unit. The average molecular weight of the polyisobutene used to produce the PIBSA is about 1300.

The precursor polyalkenylsuccinic anhyiride may also be prepared as reported in U.S. Pat. No. 3,235,484 (Colfer), incorporated herein by reference or, more preferably, by the methods reported in U.S. Pat. No. 4,883,886 (Huang) also incorporated by reference herein. As to the Colfer method, the anhydrides may be prepared by reaction of maleic anhydride with a high molecular weight olefin or a chlorinated high molecular weight olefin. In the preferred Huang method, reaction of a polymer of a $C_2$–$C_8$ olefin and maleic anhydride are carried out in the presence of a tar and side product suppressing agent.

The most commonly used sources for forming the aliphatic R substituent on the succinic anhydride compound (I) are the polyolefins, such as polyethylene, polypropylene, polyisobutene, polyamylene, polyisohexylene, etc. The most particularly preferred polyolefin (and the one used to manufacture the polyisobutenylsuccinic anhydride from Texaco) is polyisobutene. As Colfer states, particular preference is made for such a polyisobutene containing at least about 50 carbon atoms, preferably from at least 60 carbon atoms and most desirably from about 100 to about 150 carbon atoms. Accordingly, an operable carbon atom number range for R is from about 30–200 carbon atoms.

Once the polyalkenylsuccinic anhydride precursor is obtained, it is reacted with an aromatic secondary amine, at temperature in excess of about 80° C. so as to form an imide. More specifically, the polyalkenylsuccinic anhydride

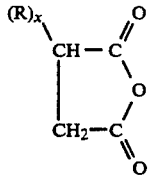

(I)

wherein R is an aliphatic alkenyl or alkyl moiety having at least about 50 carbon atoms and less than about 200 carbon atoms, is reacted with a diaromatic secondary amine of the formula:

$$Ar\ NH\ Ar^1$$

wherein Ar and $Ar^1$ are the same or different aromatic groups, or the substituted member thereof, having 6 to 50 carbon atoms. The new product is then reacted with the product selected from the group consisting of an alkanolamine and a hydroxyalkyl aminomethane of the formulas:

$$(HOR^1)_xN(H)_y$$

and $$(HOR^2)_{x'}C(H)_{y'}NH_2$$

wherein $R^1$ is an alkylene group having 1 to 6 carbon atoms, x is 1 to 3, y is 0 to 2, their sum being 3, x' and y' have the same meaning as x and y and $R^2$ is the same as $R^1$. The aromatic groups Ar and $Ar^1$ will preferably contain no more than 14 carbon atoms. Preferred specific amines are diphenylamine, phenyl-alphanaphthylamine and their alkylated derivatives.

The preferred alkanolamine is triethanolamine, and the preferred aminomethane is tris(hydroxymethyl-)aminomethane.

The reactions can be carried out over a wide range of from about 50° C. to about 300° C. in from about 0.5 hour to about 10 hours, depending on temperature and reactivity of the reactants. For specific reactions, the temperatures of reaction can be from about 50° C. to about 250° C., preferably about 100° C. to about 200° C. for the reaction between the alkenylsuccinic compound and the diarylamine. When carrying out the reaction of the alkenylsuccinicdiarylamine product with the aminomethane or alkanolamine, the temperature will generally be from about 100° C. to about 300° C., preferably about 150° C. to about 275° C. Times will run from about 1 hour or less to about 10 hours.

The alkenyl group of the alkenylsuccinic compound, preferably the anhydride or the acid, can have a number average molecular weight of from about 360 to about 2500, i.e., it will have from 30 to 200 carbon atoms. They (the alkenyl groups) may be made by any method known to the art, as by the catalytic oligomerization of an olefin, such as one containing 2 to 10 carbon atoms. Further, the oligomer so produced can be reacted with maleic anhydride by well-known methods (as by $BF_3$ catalysis) to give the alkenylsuccinic compound.

The reactants may be used in the range of about 0.1 to about 1.0 mole of diarylamine per mole of alkenylsuccinic compound and from about 0.1 to 1.2 moles of alkanolamine or aminomethane per mole of alkenylsuccinic compound. The preferred amounts of reactants are 1.0 mole of alkenylsuccinic compound, 1.0 mole of diarylamine and no more than about 0.6 mole of the alkanolamine or aminomethane.

The reaction products useful in the invention may be added to or dispersed within the liquid hydrocarbonaceous medium in need of antifouling protection in an amount of 0.5–10,000 ppm based upon one million parts of the liquid hydrocarbonaceous medium. Preferably, the antifoulant is added in an amount of from 1 to 2500 ppm.

The reaction products may be dissolved in a polar or non-polar organic solvent, such as heavy aromatic naphtha, toluene, xylene, or mineral oil and fed to the requisite hot process fluid or they can be fed neat thereto. These products are especially effective when added to the liquid hydrocarbonaceous medium during the heat processing thereof at temperatures of from 100°–550° C.

EXAMPLES

The dual fouling apparatus (DFA), as described in U.S. Pat. No. 4,578,178, was used to determine the antifoulant efficacy of a polyisobutenyl succinamide reacted with triethanolamine in various desalted crude oils as illustrated in Table 1. Furthermore, the antifoulant efficacy of a polyisobutenyl succinamide antifoulant was compared to this compound in crude oil with results detailed in Table 1. This material is sold commercially as a dispersant additive for automotive lubricating oils.

The DFA used to generate the data shown in Table I contains two independent, heated rod exchangers. In the DFA tests, rod temperature was controlled while testing. As fouling on the rod occurs, less heat is transferred to the fluid so that the process fluid outlet temperature decreases. Antifoulant protection was determined by comparing the summed areas between the heat transfer curves for control and treated runs and the ideal case for each run. In this method, the temperatures of the oil inlet and outlet and rod temperatures at the oil inlet (cold end) and outlet (hot end) are used to calculate U-rig coefficients of heat transfer every 2 minutes during the tests. From these U-rig coefficients, areas under the fouling curves are calculated and subtracted from the non-fouling curve for each run. Comparing the areas of control runs (averaged) and treated runs in the following equation results in a percent protection value for antifoulants.

$$\% \text{ Protection} = \frac{\text{Avg. } \Delta \text{ Area (control)} - \Delta \text{ Area (Treatment)}}{\text{Avg. } \Delta \text{ Area (control)}} \times 100$$

A starting polyisobutenyl succinic anhydride (average molecular weight 1300 polyisobutene) was reacted with diphenylamine in a 1/1 mole ratio. The succinamide was further reacted with triethanolamine according to Example 3 of U.S. Pat. No. 4,522,736 to yield a 50% active product diluted with mineral oil. This material is designated PBSAPT.

TABLE I

Summary of DFA Results on PBSAPT Compared to Polyisobutenyl Succinimide Antifoulant (PIBSA Succinimide) Desalted Crude Oil D, 482° C. Rod Temperature

| Additive (ppm active) | % Protection |
|---|---|
| PIBSA Succinimide (62.5) | 8 (Avg.) |
| (250) | 18 |
| PBSAPT (62.5) | 14 (Avg.) |
| (250) | 40 (Avg.) |

As shown in Table I, the PBSAPT material exhibited antifoulant efficacy in crude oil and generally was equivalent or better than PIBSA succinamide in inhibiting fouling of the tested liquid hydrocarbonaceous medium.

Another series of tests adapted to assess candidate efficacy in providing fouling inhibition during high temperature treatment of liquid hydrocarbon mediums were performed. These tests are titled the "Hot Filament Fouling Tests" and were run in conjunction with gas oil hydrocarbon mediums. The procedure for these tests involves the following:

Hot Filament Fouling Tests (HFFT)

A preweighed 24-gauge Ni-chrome wire is placed between two brass electrodes in a glass reaction jar and hold in place by two brass screws. 200 mls of feedstock are measured and added into each sample jar. One sample jar is left untreated as a control with other jars being supplied with 125 ppm (active) of the candidate material. The brass electrode assembly and lids are placed on each jar and tightly secured. The treatments are mixed via swirling the feedstock. Four sample jars are connected in series with a controller provided for each series of jars.

The controllers are turned on and provide 8 amps of current to each jar. This amperage provides a temperature of about 125°-150° C. within each sample jar. After 24 hours of current flow, the controllers are turned off and the jars are disconnected from their series connection. The wires, which have been immersed in the hot medium during the testing, are carefully removed from their jars, are washed with xylene and acetone, and are allowed to dry.

Each wire and the resulting deposits thereon are weighed with the weight of the deposit being calculated. Photographs of the wires are taken comparing untreated, treated, and clean wires from each series of experiments using a given controller.

The deposit weight for a given wire was calculated in accordance with $$\text{wt. deposit} = \left(\begin{matrix}\text{weight of wire}\\ \text{plus deposit}\end{matrix}\right) - (\text{original wire weight})$$

The percentage protection for each treatment sample was then calculated as follows:

$$\% \text{ protection} = \left[1 - \frac{\text{wt. deposit(treated)}}{\text{wt. deposit(untreated)}}\right] \times 100$$

Results are shown in Table II.

TABLE II

| Additive | ppm active | Feedstock Type | % Protection |
|---|---|---|---|
| PIBSA Succinimide | 125 | SRLGO | 40 avg. |
| PBSAPT | 125 | SRLGO | 61 |
| PIBSA Succinimide | 125 | CCLGO | 89 avg. |
| PBSAPT | 125 | CCLGO | 67 |

In Table II, SRLGO means straight run light gas oil from a midwestern refinery with CCLGO indicating a catalytic cracked light gas oil from the same midwestern refinery. PIBSA succinamide and PBSAPT are the same as per Table I.

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

I claim:

1. A method of inhibiting fouling deposit formation in a liquid hydrocarbonaceous medium during heat treatment processing thereof at temperatures of from about 200°-550° C., wherein, in the absence of such antifouling treatment, fouling deposits are normally formed as a separate phase within said hydrocarbonaceous medium impeding process throughput and thermal transfer, said method comprising adding to said liquid hydrocarbonaceous medium, an antifouling amount of from about 0.5–10,000 parts by weight per one million parts of said hydrocarbonaceous medium of a reaction product of a polyalkenylsuccinic anhydride having the formula

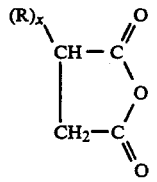

wherein R is an aliphatic alkenyl or alkyl moiety having at least about 50 carbon atoms and less than about 200 carbon atoms, with a diaromatic secondary amine to form a polyalkenylsuccinamide, followed by adding an aminoalcohol to said polyalkenylsuccinamide, said liquid hydrocarbonaceous medium comprising petroleum hydrocarbons or petrochemicals.

2. The method as recited in claim 1 wherein said liquid hydrocarbonaceous medium comprises crude oil, straight run light gas oil, or catalytically cracked light gas oil.

3. The method as recited in claim 1 wherein R comprises from about 50–150 carbon atoms and is a polyalkenyl moiety.

4. The method as recited in claim 3 wherein R comprises a repeated isobutenyl moiety.

5. The method as recited in claim 1 wherein said diaromatic secondary amine is diphenylamine.

6. The method as recited in claim 1 wherein said aminoalcohol is triethanolamine.

* * * * *